United States Patent [19]

Perkitny

[11] Patent Number: 4,575,353

[45] Date of Patent: Mar. 11, 1986

[54] COUNTERWEIGHTED AND SELF-EXTENDING MOBILE

[76] Inventor: Jerzy Perkitny, 2546 Kenilworth, Apt. 43, Cleveland Heights, Ohio 44106

[21] Appl. No.: 603,215

[22] Filed: Apr. 23, 1984

[51] Int. Cl.[4] ..... A63H 13/38; A63H 33/02; A63H 29/00; A63H 33/00

[52] U.S. Cl. ..... 446/396; 446/453; 446/458; 446/487; 434/302; 40/495

[58] Field of Search ..... 446/238, 243, 396, 431, 446/487, 453, 457, 458, 491; 434/300, 302, 198, 404; D21/62; D19/62, 85; 40/495

[56] References Cited

U.S. PATENT DOCUMENTS

| | | | |
|---|---|---|---|
| 623,827 | 4/1899 | Reid | 40/495 |
| 740,143 | 9/1903 | Kellogg | 40/495 |
| 1,425,945 | 8/1922 | Congdon | 446/396 X |
| 2,585,780 | 2/1952 | Johnson | 446/396 |
| 3,387,778 | 6/1968 | Althaus | 446/431 X |
| 4,057,247 | 11/1977 | Morrison | 446/396 X |

FOREIGN PATENT DOCUMENTS

| | | | |
|---|---|---|---|
| 2651921 | 5/1978 | Fed. Rep. of Germany | 46/207 |
| 1306039 | 2/1973 | United Kingdom | 446/489 |
| 1442582 | 7/1976 | United Kingdom | 446/458 |
| 710064 | 7/1980 | U.S.S.R. | 434/302 |

*Primary Examiner*—Robert A. Hafer
*Assistant Examiner*—D. Neal Muir
*Attorney, Agent, or Firm*—Renner, Otto, Boisselle & Lyon

[57] ABSTRACT

A toy or novelty is disclosed which is in the form of standing mobile and has a series of parts each pivoted to another and each provided with eccentric weights. The weights and the arrangement of the pivots may be operative to pivot the parts from a position aligned with each other to a position extending from each other when the stability of the parts is sufficiently disturbed from the condition of stability when such parts are filed or folded. Alternatively, the parts may simply rock in an undulating fashion from the extended condition of stability. Some of the parts may have printed matter thereon which make sense or nonsense in one condition of stability or make sense or more sense in the other condition of stability. Some of the parts may include two parallel walls substantially to enclose other of said parts in the filed position. The parts may be circular in form and of reduced diameter in ascending order in one condition of stability. The weights of each part preferably decrease in mass from one part to the next and the two conditions of stability are when the centroid of the weights and pivots are aligned.

11 Claims, 6 Drawing Figures

COUNTERWEIGHTED AND SELF-EXTENDING MOBILE

This invention relates generally to a toy or novelty and more particularly to a toy or novelty comprising a series of parts which can be rocked on a surface and which instability will then cause the parts to move from a filed or folded position to a position extending from each other.

BACKGROUND OF THE INVENTION

Toys or novelties which can be made to move and when moved exhibit peculiar motions are matters of fascination for young and old alike. An example is the well known slinky which can made to walk down stairs if properly started. Such toys or novelties should be simple and inexpensive to manufacture and should present no safety hazards for children or people of all ages. Such novelties may also be used in displays or advertising.

SUMMARY OF THE INVENTION

The present invention is in the form of a toy or novelty which is in the form of a standing mobile. The term mobile simply means that the parts will move to or from one fairly stable condition or to another fairly stable condition with the first condition being wherein the parts are folded or enclosed one within another to a second position wherein the parts are extended. The parts are each eccentrically pivoted to each other and each includes eccentric counterweights. Thus, simply by rocking the assembled parts in one compact condition of stability the parts will then automatically unfold and extend to an extended position of stability. The two conditions of stability are when the centroids of the counterweights and pivots are aligned with all but the base part being substantially 180° our of phase.

The parts may be circular in form with each part in ascending order being somewhat smaller in diameter. The weights in each part may also be somewhat smaller in diameter. The weights but the upper or outermost part may be formed of parallel walls to enclose and hide from view the other parts when in the compact condition. The parts may be provided with printed matter or pictures which may make sense or nonsense in the compact condition of stability or make sense or more sense in the extended condition of stability. In other words the parts may contain pictures of caricatures of animals or people which are only completed in the extended condition of stability.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRTIPTION OF THE DRAWINGS

Figure 1:
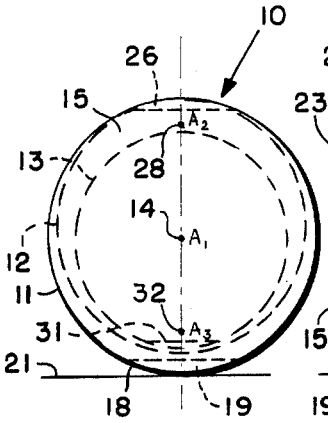
FIG. 1 is a side elevation of a toy or novelty in accordance with the present invention illustrating the pivot axes or pivot axles of the three parts illustrated.
Figure 2:
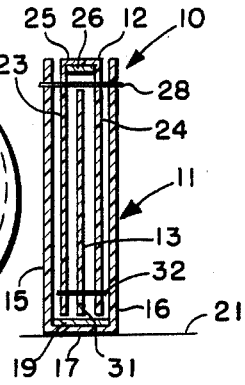
FIG. 2 is a vertical diametrical section through the toy or novelty seen in FIG. 1.

Referring first to FIGS. 1 and 2 there is illustrated a toy or novelty in accordance with the present invention in a filed, folded or compact condition of stability. The invention comprises three different parts seen at 11, 12 and 13, each of which may be circular in form. The base part 11 includes a center $A_1$ indicated at 14, two parallel circular walls 15 and 16 which are interconnected at the bottom only as seen at 17 providing a rock surface 18. Within the part 11 there is provided a counterweight 19 at the bottom which holds the part 11 upwright regardless of the condition of stability of the other parts. The part 11 is designed to be supported on a flat surface as indicated 21.

The part 12 also includes parallel circular walls 23 and 24 which are interconnected at the top, in FIGS. 1 and 2, as indicated at 25. The part 12 also includes an eccentric counterweight 26 and is pivoted to the part 11 on the pivot pin or axle $A_2$ indicated at 28. The third part 13 also includes an eccentric counterweight 31 and is pivoted to the part 12 on pin or axle $A_3$ indicated at 32.

The parts 11, 12 and 13 may be made of suitable fairly lightweight plastic while the eccentric counterweights may be made of more dense metal such as steel.

It is noted that in the stable condition of the toy or novelty in FIG. 1 the centroids of the weights 19, 31, and 26, reading in ascending order, are all aligned with the axles 28 and 32 as well as the center axis 14 of the part 11. All of the centroids, pivots and axes are vertically aligned.

Figure 3:
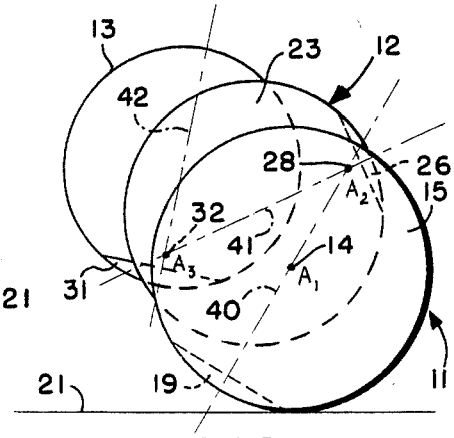
FIG. 3 is a side elevation of the toy or novelty illustrating the initial movement of the parts as the toy or novelty is rocked on a surface.

Referring now to FIG. 3, it will be seen that when the toy or novelty is rocked from its position of stability seen in FIG. 1, the weights and pivots are then no longer aligned and vertical but rather unfold to the three diametrical axes seen at 40, 41 and 42, respectively for the parts 11, 12 and 13. In such condition, the parts are unstable and will continue to rock to the position seen in FIG. 4, oscillating back and forth from the condition in FIG. 4 to a condition which is substantially the mirror image of such condition, in reducing amplitudes.

Figure 4:
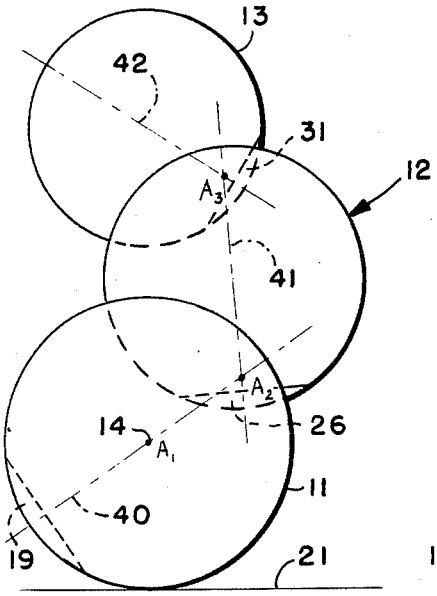
FIG. 4 is a view similar to FIG. 3 illustrating further movement of the parts which occurs as the result of such rocking.
Figure 5:
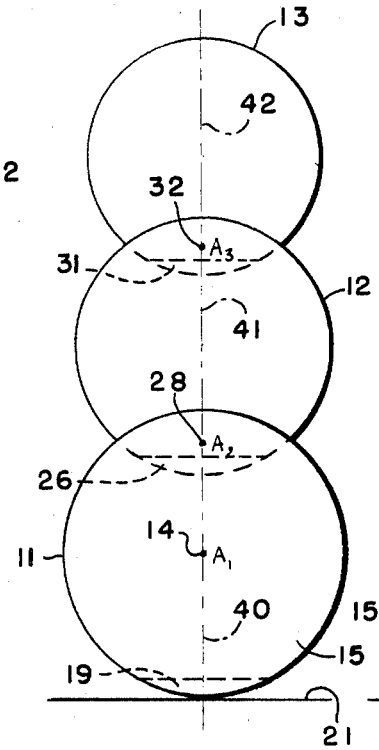
FIG. 5 is a side elevation of the toy or novelty of the present invention illustrated in the extended condition of stability.
Figure 6:
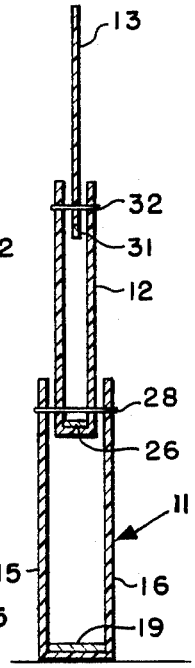
FIG. 6 is a vertical diametrical section through the parts as seen from the vertical axis of FIG. 5.

As such rocking continues, the system will eventually reach the stability position seen in FIGS. 5 and 6 wherein the axes 40, 41 and 42 are substantially vertically aligned but extending from each other. The three-part system will eventually reach stability in the FIG. 5 condition. It will be appreciated that the system may again be rocked back and forth simply by pushing it to obtain continued oscillation as represented by FIG. 4 and the mirror image of FIG. 4.

Although the parts are illustrated as circular and of a diameter slightly decreasing in ascending order as seen in FIG. 5, it will be appreciated that other shapes or configurations may be employed. For example, the uppermost part in FIG. 5 may be configured to resemble the head of an animal or person. It is, however, preferred that the lowermost part be provided with a rock surface on its lower edge to enable the rocking movement of FIGS. 3 and 4 to be obtained.

It will also be appreciated that more or fewer than three parts may be employed and that the rocking system is self-damping, but nonetheless providing unusual oscillatory movements of the parts in moving to the position of stability of FIG. 5 or moving from that position.

As previously indicated, printed or pictorial matter may appear on the faces of the parts. Printed matter may be utilized, for example, in advertising displays where the motion of the parts attracts the viewer. In such displays the bottom part may be mounted and power driven to continue the out of phase rocking movement seen in FIG. 4 and the mirror image of FIG. 4, such movement attracting the attention of the viewer.

As far as some pictorial or printed matter is concerned, each face of surface of the parts may contain words or illustrations which makes sense only in the extended stable condition of FIG. 5, or which may make one sense in the folded or filed condition of FIG. 1 and quite another sense in the extended position.

If the device is not intended to move from the initial stable position of FIG. 1 to the second stable position of FIG. 5, all of the parts may be circular and of the same diameter.

It will also be appreciated that the weights decrease in ascending order in the condition of FIG. 5 and that the moment arms through which such weights act are such as to stablize the entire system. For example, the weight 19 acting through its moment arm must counterbalance not only the part 11, but also the parts 12 and 13. The weight 26 must counterbalance both parts 12 and 13 while the weight 31 counterbalances only the part 13.

I claim:

1. A counterweighted and self-extending mobile having a base element including means supporting said base element for angular displacement, at least one additional element pivoted to the base element and pivotally movable from a folded to an extended position and having a mass placed counter to its pivot with the base element whereby sufficient angular displacement of the mobile when said additional element is in a folded condition of stability will excite the mobile to oscillate with said mass causing said additional element to extend from said base element, whereupon the damping of oscillations result in the elements obtaining a second extended condition of stability with said additional element extended from said base element, said second condition of stability being such that when angular displacement of at least said additional element again occurs, the mobile returns to the second extended condition of stability upon damping of displacement energies.

2. A mobile as set forth in claim 1 including at least a second additional element pivoted to said first additional element and having a mass placed counter to its respective pivot, with both said additional elements being pivotally movable from the folded condition of stability to the extended condition upon said initial angular displacement, and then back to the extended condition upon subsequent angular displacement upon damping of displacement energies.

3. A mobile as set forth in claim 2 wherein said base element and one additional element include two parallel walls substantially to enclose said one additional element and said second additional element, respectively, in such folded condition.

4. A mobile as set forth in claim 2 wherein at least two of said elements pivotally adjacent each other include parallel walls substantially to enclose or be enclosed in adjacent elements.

5. A mobile as set forth in claim 2 wherein each additional element includes a weight, such weights decreasing in mass from one additional element to the next, in the extended condition.

6. A mobile as set forth in claim 5 wherein the extended condition of stability is when the weights of all but the base element are below the respective pivots.

7. A mobile as set forth in claim 6 wherein the folded condition of stability is when the weight of the additional element having the weight of largest mass has moved approximately 180° l from the extended condition of stability.

8. A mobile as set forth in claim 1 wherein said base element includes two parallel walls substantially to enclose said additional element in such folded condition.

9. A counterweighted and self-extending mobile having a base element including an arcuate bottom surface supporting said base element on a plane surface for angular displacement on such surface, at least one additional element pivoted to said base element and having a mass placed counter to its pivot with the base element, whereby sufficient angular displacement of said base element will excite said additional element to oscillate about such pivot with the damping of such oscillations causing the parts to obtain a condition of stability with the additional element extending from the base element, said condition of stability being such that when angular displacement again occurs the mobile again returns to the condition of stability with the additional element extended from the base element upon damping of displacement energies.

10. A mobile as set forth in claim 9 including a second additional element pivoted to said one additional element and having a mass placed counter to its pivot with said one additional element.

11. A mobile as set forth in claim 10 wherein said one and additional elements have masses decreasing in ascending order from the base element.

* * * * *